US012114764B2

(12) United States Patent
Van Es et al.

(10) Patent No.: US 12,114,764 B2
(45) Date of Patent: Oct. 15, 2024

(54) SKIN TREATMENT HEAD WITH INTEGRATED RELEASE SYSTEM

(71) Applicant: KONINKLIJKE PHILIPS N.V., Eindhoven (NL)

(72) Inventors: Michel Van Es, Groningen (NL); Joost Tomas Glazenburg, Groningen (NL); Janny Bulten, Hoogeveen (NL); Harold Wolf, Oranje (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 689 days.

(21) Appl. No.: 17/284,485

(22) PCT Filed: Oct. 28, 2019

(86) PCT No.: PCT/EP2019/079313
§ 371 (c)(1),
(2) Date: Apr. 12, 2021

(87) PCT Pub. No.: WO2020/094430
PCT Pub. Date: May 14, 2020

(65) Prior Publication Data

US 2021/0353042 A1 Nov. 18, 2021

(30) Foreign Application Priority Data

Nov. 6, 2018 (EP) ..... 18204478

(51) Int. Cl.
*A46B 9/04* (2006.01)
*A46B 11/00* (2006.01)
*A46B 13/02* (2006.01)

(52) U.S. Cl.
CPC ..... *A46B 11/002* (2013.01); *A46B 9/04* (2013.01); *A46B 13/02* (2013.01); *A46B 2200/102* (2013.01)

(58) Field of Classification Search
CPC ..... A46B 13/02; A46B 9/04; A46B 11/002
See application file for complete search history.

(56) References Cited

U.S. PATENT DOCUMENTS 6,071,029 A 6/2000 Weinstock
8,713,739 B1 * 5/2014 Alas ..... A46B 13/02 601/114

(Continued)

FOREIGN PATENT DOCUMENTS

RU 2556507 C1 7/2015
WO 2009/141510 11/2009

(Continued)

OTHER PUBLICATIONS

International Search Report and Written Opinion Dated Jan. 2, 2020 for International Application No. PCT/EP2019/079313 Filed Oct. 28, 2019.

*Primary Examiner* — Michael D Jennings

(57) ABSTRACT

A unit of a body care device, operating a skin treatment head coupled to or integrated with the unit, includes a first connector element detachably coupling to a second connector element of a housing of the body care device to provide functional coupling of the housing and the unit; a chamber with a chamber volume for hosting a material, the chamber including a first chamber opening with a check valve; a mechanical actuator configured to transfer a force on the skin treatment head in a direction of the first connector element onto the material to expel at least part of the material via the at least one first chamber opening out of the chamber; a channel system for providing a fluid connection between the chamber and the at least one first chamber opening; and a first valve for controlling the fluid connection between the chamber and the first chamber opening.

20 Claims, 8 Drawing Sheets

(56) References Cited

U.S. PATENT DOCUMENTS

| | | | | |
|---|---|---|---|---|
| 2020/0170399 | A1* | 6/2020 | Truong | B25J 19/005 |
| 2022/0167734 | A1* | 6/2022 | Tehrani | A46B 5/0095 |

FOREIGN PATENT DOCUMENTS

| | | |
|---|---|---|
| WO | 2014009177 | 1/2014 |
| WO | 2015/174844 | 11/2015 |
| WO | 2018/064688 | 4/2018 |

* cited by examiner

SKIN TREATMENT HEAD WITH INTEGRATED RELEASE SYSTEM

CROSS REFERENCE TO RELATED APPLICATIONS

This application is the U.S. National Phase application under 35 U.S.C. § 371 of International Application No. PCT/EP2019/079313 filed Oct. 28, 2019, which claims the benefit of European Patent Application Number 18204478.4 filed Nov. 6, 2018. These applications are hereby incorporated by reference herein.

FIELD OF THE INVENTION

The invention relates to a unit for a body care device. The invention also relates to such body care device. The invention further relates to a kit of parts comprising a housing of such body care device and the unit for such body care device. Yet further, the invention relates to a method of treating a part of a skin using such body care device.

BACKGROUND OF THE INVENTION

Fluid dispensing brushes are known in the art. WO2018/064688, for instance, describes a brush comprising a housing having an opening at which there is a pad and bristles. The housing defines an interior space and a handle. In the interior space, there is located a fluid reservoir, a pump assembly having a pump cylinder tube and plunger, and a piping array which are airtight and fluidly connected to one another. In a preferred embodiment, a plurality of silicone, duckbill ejection valves are provided at the ends of the piping array and are positioned on the pad among the bristles. To enable movement of fluid from the reservoir to and out of the ejection valves, an actuator lever is provided and adapted to be operated by a user. The actuator lever is adapted to move between a first position and a second position, creating a pumping action to dispense fluid through the ejection valves.

SUMMARY OF THE INVENTION

For certain applications, a brush (or a combinations of brush/sponge/rubber) in combination with additives such as cosmetics, oils, disinfectant's, scrubs, water, etc. may be needed, for example for applying and spreading these over the skin. Additives can e.g. be cosmetics, such as body creams, cosmetics with the purpose of cleaning, exfoliating or hydrating, etc.

In current ways of working additives, such as cosmetics, are applied on the body and/or on a brush, before further application to the body. Hence, two steps need to be done by the user.

Assuming the application of a body care device wherein the brush at least partly rotates, another downside may be that additives added on a brush will be spread around (centrifugal effect) after starting rotating of the brush.

There appear to be no easy solutions to these possible problems.

Hence, it is an aspect of the invention to provide an alternative body care device, or unit therefore, which preferably further at least partly obviates one or more of above-described drawbacks. The present invention may have as object to overcome or ameliorate at least one of the disadvantages of the prior art, or to provide a useful alternative.

Amongst others, in embodiments additives, such as cosmetics, may be stored in a buffer ("chamber" or "chamber volume") that is allocated behind the brush (or other skin treatment element(s)). A dispensing system may be constructed as such that it releases the additives, such as cosmetics when activated, for example pushed on the skin. When not in use, the additives are stored inside the system, ready for use.

Hence, in a first aspect the invention provides a unit (wherein the unit is especially configured for functionally coupling to a housing of a body care device, wherein the housing comprises an actuator configured to at least partly rotate the unit about an axis (A) when the unit is functionally coupled to the housing), wherein the unit is (further) configured to be functionally coupled to a skin treatment head or wherein the unit comprises the skin treatment head, wherein the unit comprises:

- a first connector element (for detachably coupling to a corresponding second connector element of the housing to provide the functional coupling of the housing and the unit);
- a chamber with a chamber volume for hosting a material selected from the group consisting of a liquid and a semi-liquid, wherein the chamber comprises a first chamber opening, wherein in specific embodiments the first chamber opening comprises a check valve;
- a mechanical actuator, configured movable relative to the first connector element, wherein the mechanical actuator is configured to transfer a force on the skin treatment head in a direction of the first connector element onto the material, especially to expel at least part of the material via the first chamber opening out of the chamber, wherein especially the mechanical actuator is configurable in a plurality of positions relative to the first connector element (including a neutral position wherein the mechanical actuator does not transfer a force onto the material).

With such unit, it is possible to use a body care device that has a rotating treatment head, and wherein the body care device can dispense material on the skin via the treatment head. Further, with such unit, it is possible to dispense the material during operation of the device on the skin, whereas when the device is not used, or not pressed against the skin, the material may not be dispensed and stays in the unit.

The invention is especially directed for a new unit for a body care device.

Especially, the body care device comprises in embodiments a housing, which comprises an actuator configured to at least partly rotate the skin treatment head. In the present invention however, the skin treatment head may be functionally coupled to or comprised by a unit that is functionally coupled to the housing. Hence, in the present invention the housing comprises an actuator configured to at least partly rotate the unit about an axis (A) when the unit is functionally coupled to the housing.

The skin treatment head may thus be comprised by the unit or may be functionally coupled to the unit. Hence, in the latter embodiments the skin treatment head may especially be detachably coupled to the skin treatment head. In such embodiments, different types of skin treatment heads may be (chosen to be alternatively) functionally coupled to the unit and/or skin treatment heads may be replaced with newer skin treatment heads. Therefore, in embodiments the unit is especially configured to be functionally coupled to a skin treatment head or the unit comprises the skin treatment head.

Hence, especially the invention is in a first aspect directed to the unit per se. However, the unit may herein also be defined in relation to the body care device and/or skin treatment head, as the unit is especially configured to be used in the body care device.

In embodiments, the unit comprises a first connector element for detachably coupling to a corresponding second connector element of the housing to provide the functional coupling of the housing and the unit. The first connector element and the second connector element are thus especially configured to provide a functional coupling to each other in a detachable way. For instance, click-systems or click-rotation systems may be used, wherein the unit can be coupled to the housing and can also be detached. However, during operation the unit stays functionally coupled to the housing. Solutions to provide such functional coupling are known in the art; these kind of click-rotation systems are currently used to attach/detach all kind of heads to existing handles, like epilator head, brushes, callous removal head, etc.

The second connector element especially includes a rotatable element, which is actuated by the actuator.

Further, in embodiments the unit comprises a chamber with a chamber volume for hosting a material. The chamber volume may e.g. be 0.5-50 $cm^3$, such as 1-20 $cm^3$, though other volumes may also be possible.

Especially, the material is selected from the group consisting of a liquid and a semi-liquid. For instance, the material may comprise a soap or a shampoo, which may e.g. be liquid. The material may comprise a cream, which may e.g. be semi-liquid. The term "semi-liquid" may especially refer to a material having the qualities of both a liquid and a solid.

The material may especially have a viscosity that allows expelling under moderate pressure out of the chamber. Hence, especially the material is a liquid. In embodiments, the material may have a viscosity selected from the range of 0.75-25,000 cP, such as selected from the range of 0.8-10,000 cP, such as up to 5,000 cP (at 25° and ambient atmosphere). In embodiments, the material may have a viscosity of at least 1.5 cP, such as at least 2 cP, like at least 3 cp, such as at least 5 cP, like at least 10 cP (at 25° and ambient atmosphere). Water has a viscosity of 0.894 cP and e.g. chocolate syrup has a viscosity in the range of 10,000-25,000 cP. The term "material" may also refer to a combination of different materials. Further aspects of the material are described below. Note that the material is not necessarily comprised in the unit or in the body care device comprising the unit. This may only be the case during use.

The chamber comprises a first chamber opening. Via this opening the material may be expelled to the external of the chamber, such as between brushes of a treatment head. Especially, this opening is configured such that material may escape to the external when pressure is applied on the material in the chamber, whereas when no pressure is applied, the material stays in the chamber. Further, the opening may especially be configured that essentially no other material can (easily) enter the chamber via the opening. Hence, the chamber opening especially comprises a one-way valve or check valve. Therefore, especially the first chamber opening comprises a check valve. In a specific example, the first chamber opening comprises a duckbill valve.

As indicated above, especially in embodiments the material is essentially not directly released on the skin, but is released between e.g. brushes or other skin treatment element(s), such as massaging elements (such as massaging balls (or beads)), or a sponge, etc. Hence, especially the material may be released between a support for the skin treatment elements and the top of these elements.

Therefore, in embodiments the skin treatment head comprises a skin treatment head surface, wherein the skin treatment head comprises one or more skin treatment elements, wherein the one or more skin treatment elements comprise distal ends defining a second face remote from the skin treatment head surface, wherein the first chamber opening comprises a nozzle, wherein the nozzle is configured between the skin treatment head surface and the second face when the skin treatment head is comprised by the unit or functionally coupled to the unit. Hence, the nozzle may protrude from the skin treatment head surface, but may especially be lower than the height or length the skin treatment elements extend from the skin treatment head surface.

The skin treatment element(s) may comprise e.g. bristles, massaging elements, a sponge, etc. The skin treatment elements may have one or more functionalities of exfoliating elements (to 'scrape away' dead skin cells), scrubbing elements (to 'scrape away' dead skin cells and/or open black heads), hydrating elements (to add cosmetics to (deeper layers of) the skin), ingrown hair prevention elements (to open thin layer of skin above ingrown hairs to get these out of skin again), rubber elements (for various functions, e.g. distributing cosmetics over the skin), etc.

The skin treatment head may also include a plurality of different types of skin treatment elements, such as massaging elements enclosing an area with a sponge, or massaging elements enclosing an area with bristles, or bristles enclosing an area with a sponge, etc. Hence, in specific embodiments, the skin treatment head may comprise a plurality of bristles as skin treatment elements, wherein the nozzle is configured between the bristles. Alternatively or additionally, the skin treatment head comprises a plurality of massaging elements as skin treatment elements, wherein the nozzle is configured between the massaging elements. Yet alternatively or additionally, the skin treatment head comprises a sponge-like element as skin treatment element, wherein the nozzle extends into the sponge-like element.

Massaging elements may include e.g. rotatable massaging balls (which may rotate relative to the skin treatment head (along one or more axes)).

In embodiments, the chamber may have a second opening which can be used for the introduction of the material. Such second opening may be closed after introduction of the material, such as with a turn closure. In further specific embodiments, the chamber opening, such as the check valve is integrated in the (turn) closure, such that the material may be introduced in the chamber when the (turn) closure is removed, and when the chamber is closed with the (turn) closure, the material may only escape from the chamber via the chamber opening, such as the check valve. Closures other than turn closures may also be used, such as a plug, or a screw cap.

The chamber may in embodiments be refillable. In yet other embodiments, the chamber may essentially be closed, except for the chamber opening for providing the material to the external. In such embodiments, there may be a welded melted closure. In yet further embodiments, the chamber may comprise a disposable or the chamber may be formed by a disposable, such as a bag or sachet. The disposable may comprise the chamber opening or may be configurable in the unit such that a functional coupling with the chamber opening can be created.

As also indicated above, the material may have to be expelled from the chamber during use of the skin treatment device. This may be achieved when the user pushes (gently) the skin treatment head against the skin and the force on the skin is translated into a force on the material. For instance, the chamber may be compressed whereby the material may be expelled from the chamber. After removal of the pressure on the skin, the force on the material is also terminated and not material will be further expelled from the chamber. The translation of the force is thus especially a mechanical translation and allows the effect without further actions (like pushing a button) or without e.g. an electronic device based actuation of the material.

Therefore, in embodiments, the unit further comprises a mechanical actuator, configured movable relative to the first connector element, wherein the mechanical actuator is configured to transfer a force on the skin treatment head in a direction of the first connector element (and parallel to the axis (A)) onto the material to expel at least part of the material via the first chamber opening out of the chamber, wherein the mechanical actuator is configurable in a plurality of positions relative to the first connector element including a neutral position wherein the mechanical actuator does not transfer a force onto the material.

Hence, in embodiments the mechanical actuator may essentially be configured movable relative to the housing. Further, in embodiments the mechanical actuator may be configured to reduce the volume of the volume chamber when a force on the skin treatment head in a direction of the first connector element (and parallel to the axis (A)) is exerted. Hence, especially the mechanical actuator may be configured to reduce the volume of the volume chamber as a volume reduction mechanism is activated by the user (by applying the force on the skin treatment head (in a direction of the first connector element (and parallel to the axis (A)). Hence, the mechanical actuator may in embodiments be or include a volume reduction mechanism.

During use, the user may temporarily push (the skin treatment head of the body care device on the skin), and release thereby material which can be used during treatment of the skin. When the user notices that new or more material is needed, the user can again temporarily push the skin treatment head against the skin, whereby new or more material is released via the chamber opening (until there is no material anymore, of course).

Phrases like "expel the material" or "release the material", and similar phrases, especially refer to an expelling or a release of a part of the material, i.e. may refer to a dose (of the material).

As the volume of the material in the (volume of the) chamber may decrease over time, it may be useful when the material is permanently under pressure, but such that is does not spontaneously releases from the chamber via the chamber opening. Hence, in embodiments the unit may further comprise a spring-loaded element configured to provide a continuous pressure to the material over at least part of a filling range of the chamber volume with the material. The term "filling range" refers to the total volume of the material relative to the total volume of the chamber (when the chamber is only subject to ambient pressure). The spring loaded element may comprise a spring and a membrane, wherein the membrane is configured as barrier between the material and the spring.

Different types of mechanical actuation can be chosen to expel the material from the chamber.

In embodiments, the chamber comprises a chamber enclosure enclosing at least part of the chamber volume, wherein the chamber enclosure comprises a chamber wall having a cylindrical shape, wherein at least part of the chamber wall is compressible. Especially, in embodiments at least part of the chamber enclosure may be one or more of flexible and compressible, for facilitating the transfer of the force in a direction of the housing onto the material. Hence, by compressing the chamber (by pushing the skin treatment head on e.g. the skin), the material may be released from the chamber. Hence, in embodiments, the chamber enclosure, or at least part thereof, may be configured as mechanical actuator. In specific embodiments, the chamber wall is especially compressible in a direction of the first connector element (and parallel to the axis (A). Hence, in a safe way the material may be store in a chamber. Hence, in embodiments the term "movable" and similar terms in relation to the mechanical actuator may also imply "compressible".

Especially, the unit has an essentially circular cross-section. Further, especially in embodiments the unit may have an axis of rotation, which, when functionally coupled to the housing, is essentially coinciding with the axis (A). The axis (A) may also be indicated as axis of rotation.

Between a non-compressible state (neutral) and an essentially fully compressed state, a plurality (or in embodiments essentially stepless) number of other states may be available. Hence, the mechanical actuator may be configurable in a plurality of positions relative to the first connector element including a neutral position wherein the mechanical actuator does not transfer a force onto the material, and e.g. an end state, wherein no further force may be applied anymore (without further reducing the volume or force on the material).

When the unit is not in use, (unintentional) external pressure may lead to undesired release of the material. This might be prevented by only allowing the material to be released when functionally coupled to the housing. Also to this end, the unit may further comprise a channel system for providing a fluid connection between the chamber and the first chamber opening. In this way, the material may only leave the chamber via the chamber opening via one or more channels of the channel system. In specific embodiments, the unit may further comprise a first valve for controlling the fluid connection between the chamber and the first chamber opening, wherein the first connector element is also configured to control the first valve, wherein the first valve is closed when the housing and the unit are not functionally coupled, and wherein the first valve is open when the housing and the unit are functionally coupled.

The first valve may be comprised by the channel system and may be closed when the housing and unit are not functionally coupled and may be opened when the housing and unit are functionally coupled. To this end, the first connector element is also configured to control the first valve. The first connector element may directly exercise a force on the first valve when the functional coupling is made (between the housing and the unit), or there may be one or more intermediate elements that transfer a (part of a) force applied when functionally coupling the housing and the unit to the valve. Different embodiments may be possible.

For instance, in embodiments the channel system may further comprise a valve system, wherein the valve system comprises a sliding element and a sleeve element for slidably hosting the sliding element, wherein:

- the valve system is configurable in at least two configurations of the sliding element relative to the sleeve element, wherein in a first configuration the first valve is closed, and wherein in a second configuration the first valve is open;
- the channel system further comprises a spring element configured to maintain the valve system in the first configuration, wherein further the spring element is compressible until at least the second configuration of the valve system can be reached; and the first connector element is functionally coupled to one of the sleeve element and the sliding element, wherein the first connector element is further configured to keep the valve system in the second configuration when the housing and the unit are functionally coupled.

For instance, the sliding element may include an opening and/or a channel which in the first configuration is (are) not in fluid communication with an opening and/or the channel of the sleeve element. However, in the second configuration the opening and/or the channel of the sliding element is (are) in fluid communication with the opening and/or the channel of the sleeve element. Hence, in the first configuration the valve of the valve system (or of the channel system) is closed, and in the second configuration the valve of the valve system (or of the channel system) is open. Only in the latter configuration, the material from the chamber is in fluid contact with the chamber opening. Herein, the terms "opening" or "channel" may also (independently) refer to a plurality of (different) opening or a plurality of (different) channels, respectively.

The sleeve element and slide element may e.g. be configured as a slidably male-female connection. The sleeve element may thus especially have corresponding shapes, such as a hollow circular shape with a rod with a circular cross-section, or a hollow hexagonal shape with a rod with a hexagonal cross-section, etc.

In embodiments of the unit, the sliding element may slide relative to the sleeve; in other embodiments of the unit, the sleeve element may slide over the sliding element.

It may be desirable to have a plurality of chamber openings, such as to better distribute the material over the skin treatment head. Hence, in embodiments the chamber comprises a plurality of the first chamber openings. As indicated above, each of these first chamber openings may be check valves, such as e.g. duckbill valves.

In yet a further embodiment, the unit may further comprises a second valve for controlling the fluid connection between the chamber and the second chamber opening, wherein the mechanical actuator is configured to control the second valve, wherein the second valve is closed when the mechanical actuator is configured in the neutral position (and wherein the second valve is not closed when the mechanical actuator is not configured in the neutral position).

The unit may be part of a body care device, together with a skin treatment head, either comprised by the unit or functionally coupled thereto. Hence, in yet a further aspect the invention also provides a body care device for treating a skin, the body care device comprising the housing, the unit and the skin treatment head as defined herein (wherein the housing further comprises an actuator configured to at least partly rotate the unit about an axis (A), when the unit is functionally coupled to the housing), wherein the skin treatment head is comprised by the unit or functionally coupled to the unit.

The embodiments indicated above (and below) related to the unit may thus also apply to the skin treatment head.

Especially, in embodiments the skin treatment head comprises a skin treatment head surface, wherein the skin treatment head comprises one or more skin treatment elements, wherein the one or more skin treatment elements comprise distal ends defining a second face remote from the skin treatment head surface, wherein the first chamber opening comprises a nozzle, wherein the nozzle is configured between the skin treatment head surface and the second face. Further, especially, in embodiments the skin treatment head comprises a plurality of bristles as skin treatment elements, wherein the nozzle is configured between the bristles, or wherein the skin treatment head comprises a plurality of massaging elements as skin treatment elements, wherein the nozzle is configured between the massaging elements, or wherein the skin treatment head comprises a sponge-like element as skin treatment element, wherein the nozzle extends into the sponge-like element. However, other embodiments indicated herein in relation to the unit (or the kit or the method) may apply as well.

In yet a further aspect, the invention also provides a kit of parts comprising the unit, the housing, and the skin treatment head as defined herein, wherein the skin treatment head is comprised by the unit or is can be functionally coupled to the unit. However, other embodiments in relation to the unit (or the body care device or the method) indicated herein may apply as well for the kit of parts.

In embodiments, the kit may further comprise a container, wherein the container contains the material selected from the group consisting of a liquid and a semi-liquid. The container may in embodiments be selected from the group consisting of a flask, a tube, a bag, a pouch, a tin, etc. Examples of the material are described elsewhere. In the kit of parts, the chamber may in embodiments be (pre)filled and may in other embodiments not be filled.

In yet a further aspect, the invention also provides a kit of parts comprising the body care device as defined herein, and a container, wherein the container contains the material selected from the group consisting of a liquid and a semi-liquid. The container can be used to fill or to refill the chamber.

In yet a further aspect, the invention also provides a method of treating a part of a skin using the body care device as defined herein, the method comprising (a) providing a material selected from the group consisting of a liquid and a semi-liquid contained in the chamber to one or more of (i) the part of the skin and (ii) the skin treatment head, (b) applying the skin treatment head to the part of the skin, rotating the skin treatment head, and optionally (c) moving the skin treatment head over the part of the skin. Due to the application on the skin, or due to providing some additional pressure, permanently or temporarily, the material may be released from the unit and in this way contact the skin. As indicated above, the material from the chamber may especially be released between the treatment head surface (from which the skin treatment elements extend) and a second face defined by distal ends of the treatment head elements. The method may especially be a cosmetic method.

In specific embodiments, the material comprises one or more of a cosmetic material, a skin care material, and a pharmaceutical material. The material may comprise an active ingredient. The active ingredient may e.g. include charcoal. Good results may be obtained with charcoal from the Poales order of plants, such as Poaceae. The Poales are an order of flowering plants in the monocotyledons, and includes families of plants such as the grasses (Poaceae), bromeliads, and sedges.

Further specific embodiments are described below.

The body care device may be configured as facial cleaning (also indicated as "cleansing") device. Hence, especially the body care device may be a facial cleaning device. However, the body care device may also be configured for other skin cleaning applications. For different parts of the skin, optionally a plurality of treatment heads may be provided, each especially devoted to a specific part of the skin. Alternatively or additionally, the body care device may include a control system, configured to control the actuator and to offer different treatment schemes, e.g. with different settings like rotational speed, oscillation frequency, axial vibration frequency, etc., etc.

The term "controlling" and similar terms especially refer at least to determining the behavior or supervising the running of an element. Hence, herein "controlling" and similar terms may e.g. refer to imposing behavior to the element (determining the behavior or supervising the running of an element), etc., such as e.g. measuring, displaying, actuating, opening, shifting, changing temperature, etc. Beyond that, the term "controlling" and similar terms may additionally include monitoring. Hence, the term "controlling" and similar terms may include imposing behavior on an element and also imposing behavior on an element and monitoring the element. The controlling of the element can be done with a control system, which may also be indicated as "controller". The control system and the element may thus at least temporarily, or permanently, functionally be coupled. The element may comprise the control system. In embodiments, the control system and element may not be physically coupled. Control can be done via wired and/or wireless control. The term "control system" may also refer to a plurality of different control systems, which especially are functionally coupled, and of which e.g. one control system may be a master control system and one or more others may be slave control systems. A control system may comprise or may be functionally coupled to a user interface.

The system, or apparatus, or device may execute an action in a "mode" or "operation mode" or "mode of operation". Likewise, in a method an action or stage, or step may be executed in a "mode" or "operation mode" or "mode of operation". The term "mode" may also be indicated as "controlling mode". This does not exclude that the system, or apparatus, or device may also be adapted for providing another controlling mode, or a plurality of other controlling modes. Likewise, this may not exclude that before executing the mode and/or after executing the mode one or more other modes may be executed.

However, in embodiments a control system may be available, that is adapted to provide at least the controlling mode. Would other modes be available, the choice of such modes may especially be executed via a user interface, though other options, like executing a mode in dependence of a sensor signal or a (time) scheme, may also be possible. The operation mode may in embodiments also refer to a system, or apparatus, or device, that can only operate in a single operation mode (i.e. "on", without further tunability).

Especially, the body care device may be a handheld device. However, the body care device may also be integrated in a robot configured for assisting or treating people, like elderly people or people in a hospital, etc. The device is especially configured for treating the skin of a human (including infants). Hence, also different treatment heads and/or different treatment schemes may also be used for different types of people, e.g. dependent upon the age. Hence, the invention also provides a kit of parts, including a body care device and one or more treatment heads, especially a plurality of different treatment heads (with the body care device especially configured for use with detachable treatment heads).

Essentially, the body care device comprises a housing and a skin treatment head associated (via the unit) with the housing. The skin treatment head is in general associated (via the unit) with the housing via an axis which is functionally coupled with the actuator. The treatment head may be associated (via the unit) with the housing, such as with the axis, in a permanent way or in a releasable way. In the latter option, the treatment head may be replaced when considered desirable, e.g. because of hygienic reasons, when treating a different part of the skin, or when the treatment head loses functionality (e.g. due to erosion). Hence, especially the skin treatment head is detachable associated (via the unit) to the housing. For instance, Snap-On snap-off means, or a screw-thread connection may be applied, though other options may also be possible. Similar means may in embodiments be applied for functionally coupling the unit and the housing.

As indicated above, the housing further comprises an actuator configured to rotate the skin treatment head about an axis (A). Especially, the actuator is configured to (at least partly) rotate the treatment head (during use of the device). Especially, the rotations may be full rotations (i.e. rotation angle 360°). However, in yet other embodiments the rotations may be part rotations, and the treatment head may rotate about the axis A in an oscillatory way. In such embodiments, the rotation angle is especially at least 10°, such as at least 30°, such as in the range of 15-30°. Hence, the treatment head is especially rotatably associated with the housing. The treatment head can be rotated relative to the housing by the actuator. The phrase "configured to (at least partly) rotate the skin treatment head about an axis" may thus in embodiments refer to full rotations ("configured to rotate the skin treatment head about an axis"), i.e. rotation angles of 360°, and may in other embodiments refer to part rotations, i.e. oscillations over a rotation angle of e.g. 10-30° ("configured to at least partly rotate the skin treatment head about an axis"). In both types of embodiments, the treatment head rotates (at least partly) about an axis (of rotation). Hence, the actuator may be configured to rotate (rotation angles of 360°) the skin treatment head about an axis and/or the actuator may be configured to oscillate (rotation angles <360°, especially <<360°) the skin treatment head about an axis.

In yet other embodiments, the treatment head may include different portions that may rotate with different speeds and/or different angles. Hence, the actuator may also be configured to rotate different portions of the treatment head with different rotation conditions especially selected from the range of rotation speed (including direction) and rotation angle.

However, the actuator may also be used to apply other movements to the treatment head, such as a vibrational movement, which may especially be parallel to the rotation axis. Hence, in embodiments the actuator is further configured to vibrate the skin treatment head parallel to the axis (A). The term "actuator" may also refer to a plurality of actuators. Different actuators may be configured for different movements. A non-limiting example of a similar system is described in WO2014009177A1, which is herein incorporated by reference.

Useful rotational speeds for the rotation of the treatment head (about the axis of rotation, herein also indicated as "rotational axis") may be selected from the range of up to 350 rpm, such as in the range of 50-300 rpm, like especially in the range of 120-280 rpm.

Useful frequencies for the oscillation may be selected from the range of up to 350 Hz, like in the range of 60-300 Hz, especially in the range of 90-160 Hz.

A displacement (parallel to the axis), in the case of a vibration movement, relative to a rest position may e.g. be selected from the range of up to 0.01-2 mm (in a single direction), and especially about 0.05-1 mm peak-to-peak. Frequencies for the vibration may be selected from the range of up to 350 Hz, such as selected from the range of 20-350 Hz, such as in the range of 50-300 Hz.

In embodiments, the skin treatment head (or "brush") comprises a plurality of bristles.

The bristles may be configured in tufts, such as at least 10 tufts, like in the range of 10-500 tufts, like in the range of 20-200 tufts. The head may comprise e.g. in the range of 10-10,000 bristles, such as at least 100 bristles. A tuft may e.g. include 2-50 bristles, like 5-25 bristles.

The treatment head may be substantially flat, i.e. a flat surface, or may have a curved surface, such as a curvature in one dimension (like a cylindrical surface) or a curvature in two dimensions, like a spherical segment. This surface is herein also indicated as "treatment head surface". This surface may in embodiments have an area size of in the range of 1-100 $cm^2$, especially 1.5-50 $cm^2$. Further, the treatment head may in embodiments especially have a circular cross-section, with especially the rotational axis in the center of the circular cross-section.

In specific embodiments, the bristles have a bristle height (h1) relative to said treatment head surface especially selected from the range of 4-30 mm, even more especially 8-20 mm. Further, in embodiments the bristles have especially a bristle thickness selected from the range of 20-300 μm, even more especially 30-150 μm. With such bristles, the desired flexibility and strength may be obtained, desirable by the user. The height of the bristles may vary over the treatment head surface. For instance, the bristle height may be larger at the edge and smaller closer to the center (rotational axis) of the treatment head. Hence, the height of the bristles may vary along the radius from higher to lower or from lower to higher. For instance, the bristles may be configured to provide a curved brush. Especially, the bristles comprise a polyamide, such as PA 612 (known in the art).

The device, for treating the skin, may comprise a housing, a shaft located in the housing having a longitudinal axis and an end for receiving a skin treating part, and a drive means configured to cause the shaft to rotate about its longitudinal axis, and optionally also to vibrate in a direction along the longitudinal axis, wherein the drive means comprise a rotational drive unit for rotating the shaft and an vibration generator for vibrating the shaft, the vibration generator is located about the shaft such that the shaft is rotatable relative to the vibration generator, the vibration generator comprises a solenoid and a flux assembly, and the flux assembly is moveable along the shaft relative to the solenoid.

This arrangement provides the advantage that in use, when a skin treating part is attached to the end of the shaft, the skin treating part moves substantially perpendicular to the skin which improves the cleaning and the massaging effect on the skin. Furthermore, the vibration generator is not coupled to the rotational drive unit and so the vibrating movement can be controlled independently to the rotation of the shaft.

Especially, the rotational drive unit and the vibrating generator are configured such that the speed of the rotation and the frequency of the vibration of the shaft can be independently changed of one another in response to a user input.

Advantageously, the user can therefore adjust the frequency and the speed of rotation to their personal preference. Especially, the flux assembly comprises an inner and an outer flux concentrator and a magnet located there between. The arrangement of the flux assembly concentrates the magnetic forces emitted by the magnet.

In embodiments, the outer flux concentrator is made of a base panel having a peripheral side panel, and the inner flux concentrator is received within the peripheral side panel, the magnet is located between the inner flux concentrator and the base panel, and a gap is formed between the inner flux concentrator and the peripheral side panel for receiving the solenoid.

Conveniently, the device further comprises first and second supports holding the shaft, the flux assembly being located about the shaft between the first and second supports and the solenoid being attached to one of the supports.

Advantageously, the flux assembly is retained between the first and second supports such that it cannot accidentally fall off the shaft.

Conveniently, the shaft is held by the first and second supports such that the shaft is rotatable relative to the supports about the longitudinal axis but prevented from moving along the longitudinal axis relative to at least one of the supports.

This arrangement enables the axial movement of the flux assembly to be transferred to the shaft as the flux assembly impacts at least one of the supports The shaft may comprise a circumferential groove in which the one of the supports locate so as to prevent the shaft from moving along the longitudinal axis relative to the support which located in the groove.

Advantageously, as the flux assembly impacts the support located in the groove, the support is moved in an axial direction and transfers the axial movement to the shaft.

Especially, one of the supports is formed with a stop which the flux assembly impacts as it vibrates. As the stop takes the impact of the flux assembly, wear of the support formed with the stop is advantageously reduced.

In one embodiment, a spring is located between the first and the second support and the flux assembly so as to reduce the impact as the flux assembly vibrates.

This arrangement advantageously reduces audible noise produced as the flux assembly impacts the first or second support.

The device may further comprise a power source powering the drive means. Advantageously, this arrangement enables a single power source to power the drive means reducing size and weight of the device. In embodiments, the device may further comprise an inverter for changing the current supplied by the power source to alternating current. This causes the polarity of the solenoid to change so that it alternates between being attracted and repelled to the magnet. Conveniently, the device may in embodiments comprise a frequency converter for changing the frequency of the alternating current.

Advantageously, the frequency converter is configured to change the frequency in response to a user input such that the strength of the vibrating movement of the shaft and so the tuft can be changed to the personal preference of a user.

The above embodiments describe options to introduce a vibratory movement, when desired. However, also options may be chosen to introduce a vibratory movement parallel to the rotation axis; the invention is not limited to these specific embodiments described above.

BRIEF DESCRIPTION OF THE DRAWINGS

Embodiments of the invention will now be described, by way of example only, with reference to the accompanying schematic drawings in which corresponding reference symbols indicate corresponding parts, and in which.

The schematic drawings are not necessarily to scale.

DETAILED DESCRIPTION OF THE EMBODIMENTS

Figure 1:
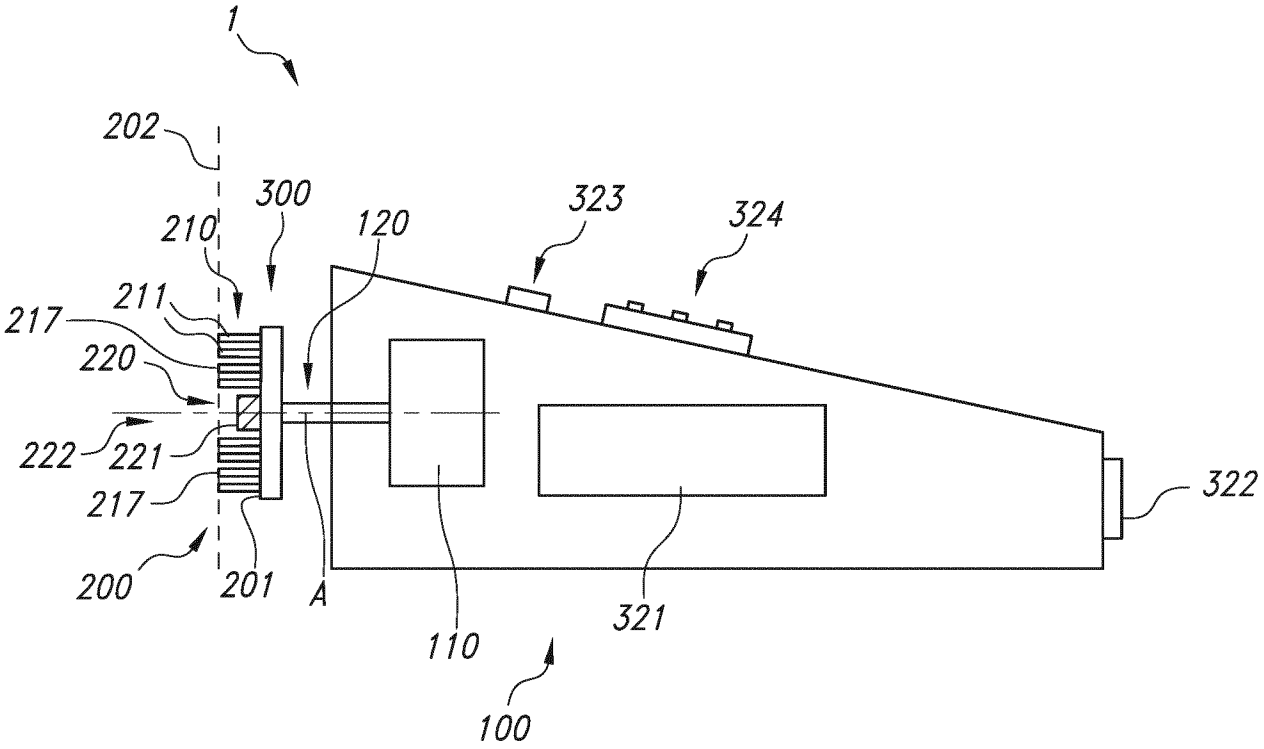
FIG. 1 schematically depicts an embodiment of the body care device.

FIG. 1 schematically depicts an embodiment of the device, indicated with reference 1, especially for use in cleansing the skin, such as the skin of a face, though additionally or alternatively other uses may also be possible, such as e.g. hydrating the skin, exfoliating the skin, etc. (see also above). Here, the device, especially for treating the skin, comprises a housing 100 and a skin treatment head 200 rotatably associated with said housing 100. The housing 100 encloses an actuator 110 configured to rotate said skin treatment head 200. Further, the housing includes in this embodiment a rechargeable battery 321 (though other options may also be possible). Yet further, the housing 100 may comprise one or more LED indicators 323 and a user interface 324. Further, the housing may include a means 322 for receiving electrical power for charging the battery, such as a socket known in the art.

The skin treatment head 200 comprises bristles 211 associated with the treatment head 200. The bristles 211 may be configured in tufts, see also above.

The actuator 110 is especially configured to rotate the skin treatment head 200 about an axis A (axis of rotation). This axis may be parallel, but is not necessary parallel to a body axis of the device.

Here, in this schematically depicted embodiment, the skin treatment head 200 comprises a first region 210 comprising a plurality of bristles 211. The skin treatment head 200 also comprises a second region 220 comprising a porous flexible material 221. The porous flexible material 221 may comprises a sponge 222, such as a natural sponge or a synthetic sponge. Reference 201 indicates a treatment head surface. The bristles 211 extend from this surface.

FIG. 1 schematically depicts an embodiment wherein the skin treatment head 200 comprises a skin treatment head surface 201. The skin treatment head 200 comprises one or more skin treatment elements, here bristles 211, wherein the one or more skin treatment elements 210 comprise distal ends defining a second face 202 remote from the skin treatment head surface 201. The skin treatment element(s) may extend from the skin treatment head surface 201.

Here, also embodiments are included with only bristles, with only a sponge, with only massaging elements, or a combination of two or more of these.

In the above schematically depicted embodiment, a unit 300 may be available, which will further be elucidated below.

In this idea, the additives, such as cosmetics are stored in a buffer that is allocated behind the brush. A dispensing system is constructed as such that it releases the additives, such as cosmetics when activated, for example pushed on the skin. When not in use, the additives are stored inside the system, ready for use. The release system may be based on duckbill valves, the way of working is described in the paragraph below.

Hence, FIG. 1 also schematically depicts an embodiment of the body care device 1 for treating a skin, wherein the body care device 1 comprises the housing 100, the unit 300 and the skin treatment head 200. Here, the skin treatment head 200 is comprised by the unit 300. In embodiments, the skin treatment head may detachably connected to the unit 300.

Reference 120 refers to a second connector element (of the housing 100), which may be used to functionally couple the housing 100 and the unit 300 (via a corresponding first connector element of the unit 300, see also below).

Figure 2A:
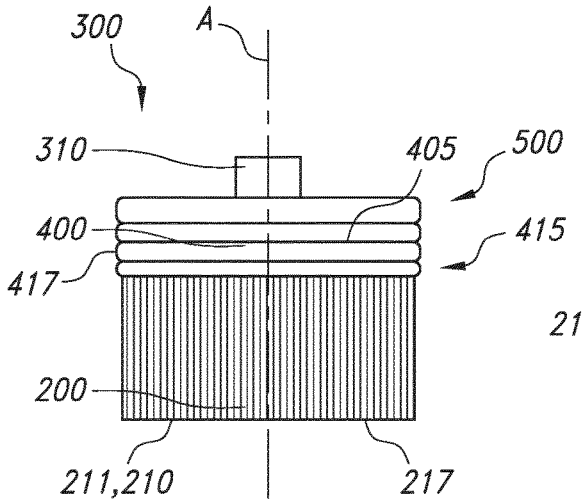
FIGS. 2*a*-2*d* schematically depict some embodiments of the unit.
Figure 2B:
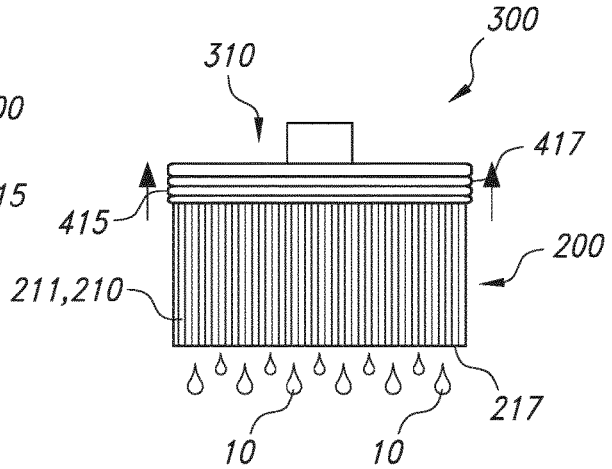
Figure 2C:
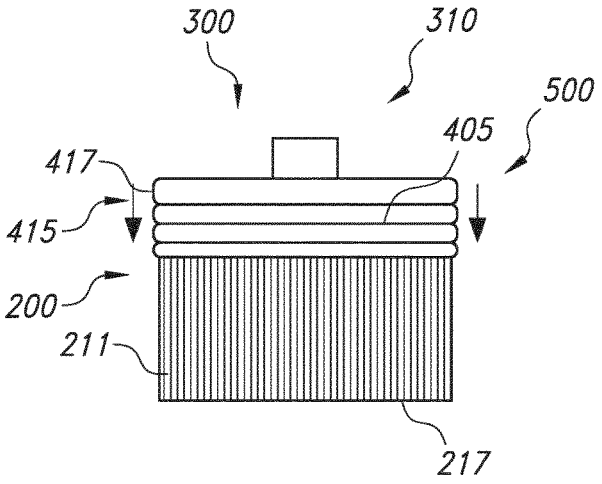
Figure 2D:
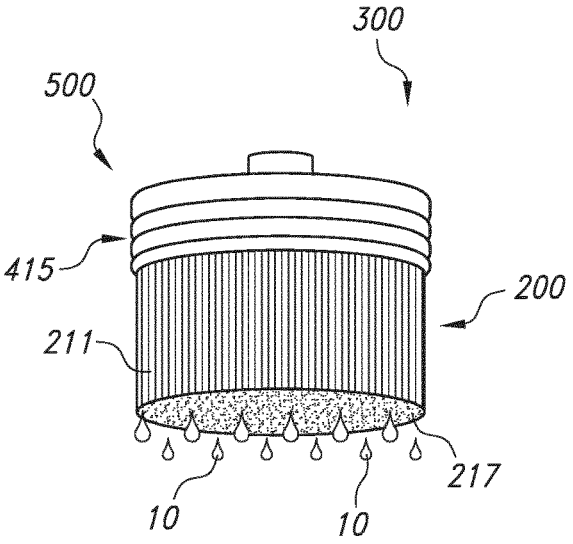

FIGS. 2*a*-2*d* schematically depict an embodiment. FIG. 2*a* schematically depicts an embodiment wherein the main components may be a connector, e.g. to attach a shaver handle or (body care) handle, a manually operated pump/buffer systems and a brush which can also be a sponge and/or rubber or combinations of these three, or other options. FIG. 2*b* schematically depicts that when the brush is pushed towards the connector, for example when on the skin, the pump/buffer system is compressed and it releases certain amount of materials, such as cosmetics, oil, disinfectant's, scrubs, water etc. FIG. 2*c* schematically depicts that when not pushed, the pump/buffer system expands to its initial shape again. FIG. 2*d* schematically depicts an embodiment wherein, e.g. on the side, a valve can be seen via which the buffer may be filled (prefilled option) and/or can be refilled (refillable option).

FIGS. 2*a*-2*b* (and also FIGS. 3*a*-3*c*, 5*a*-5*c*, 6, 7*a*-7*b*, 8) schematically depict an embodiment of the unit 300. The unit 300 is configured for functionally coupling to a housing 100 of a body care device 1, see FIG. 1. As indicated above, the housing 100 comprises an actuator 110 configured to at least partly rotate the unit 300 about an axis A when the unit 300 is functionally coupled to the housing 100. The unit 300 is further configured to be functionally coupled to a skin treatment head 200 or the unit 300 comprises the skin treatment head 200. In most of the schematically depicted embodiments, the skin treatment head 200 is schematically depicted as to be comprised by the unit 300.

Amongst others, the unit 300 in embodiments comprises a first connector element 310 for detachably coupling to a corresponding second connector element 120 of the housing 100 to provide the functional coupling of the housing 100 and the unit 300. This may e.g. be detachable a male-female connection, such as including a screw-thread connection.

Further, in embodiments the unit 300 comprises a chamber 400 with a chamber volume 405 for hosting a material selected from the group consisting of a liquid and a semi-liquid. The chamber 400 comprises a first chamber opening 410 (see e.g. FIGS. 3*a*-3*c*, etc.), wherein the first chamber opening 410 comprises a check valve 412.

Further, the unit 300 may in embodiments comprise a mechanical actuator 500, configured movable relative to the first connector element 310. The mechanical actuator 500 is configured to transfer a force on the skin treatment head 200 in a direction of the first connector element 310 (and parallel to the axis A) onto the material 10 to expel at least part of the material via the first chamber opening 410 out of the chamber 400. The mechanical actuator 500 is configurable in a plurality of positions relative to the first connector element 310 including a neutral position (FIG. 2*a*) wherein the mechanical actuator 500 does not transfer a force onto the material 10, and a position wherein the mechanical actuator 500 does transfer a force onto the material 10 (see FIG. 2*b*). Here, the mechanical actuator 500 may be a compressible chamber 400; the chamber may have a compressible chamber wall (compressible in a direction of the first connector element 310 (and parallel to the axis A).

Figure 3A:
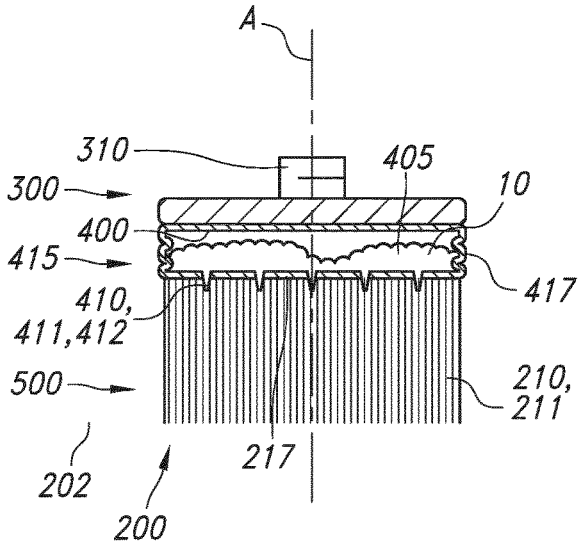
FIGS. 3*a*-3*c* schematically depict some further embodiments and aspects of the unit.
Figure 3B:
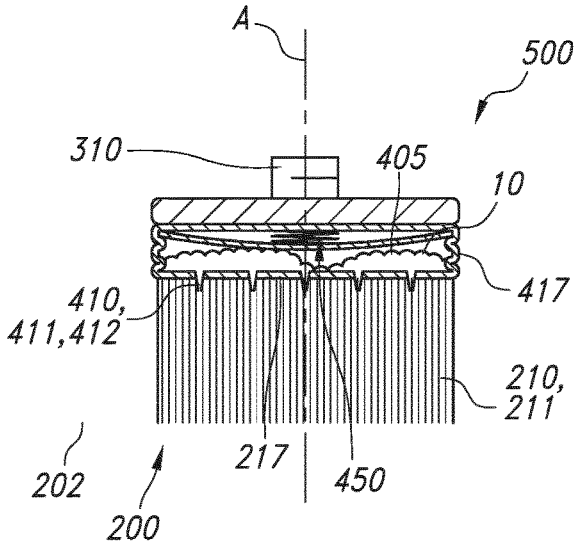
Figure 3C:
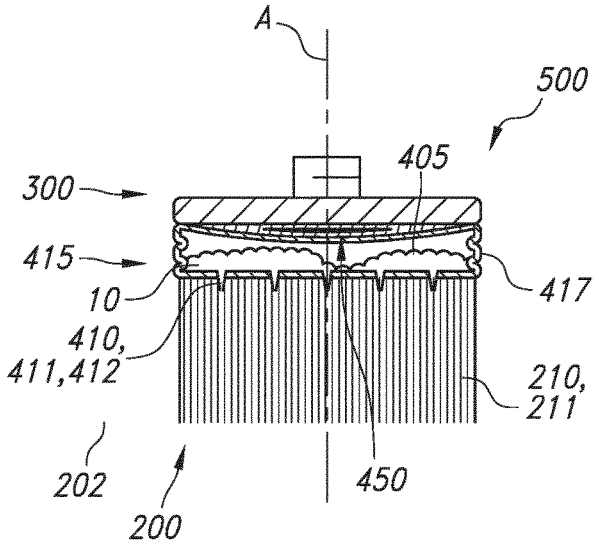

FIGS. 3*a*-3*c* schematically depict further embodiments, amongst others for explaining embodiments of the pump/buffer mechanism. An amount of material, such as cosmetics, oil, disinfectant's, scrubs, water etc. inside the buffer. One or more of buffer or chamber openings may be available, such as (miniature) one-way valves (for example "duck-bill" or "ketchup bottle valve", see also FIGS. 4*a*-4*b*. Via these chamber openings, the material, such as cosmetics, oil, disinfectant's, scrubs, water etc., may be released. In embodiments, an extra spring loaded element may be needed to add a continuous pressure on the buffer with material, such as cosmetics, oil, disinfectant's, scrubs, water etc.

FIGS. 3*b* and 3*c* schematically depict an embodiment wherein the unit 300 further comprising a spring-loaded element 450 configured to provide a continuous pressure to the material over at least part of a filling range of the chamber volume 405 with the material.

FIGS. 3*a*-3*c*, but also other figures, schematically depict embodiments wherein the first chamber opening 410 comprises a check valve 412, such as a duckbill valve.

Further, FIGS. 3*a*-3*c*, but also other figures, also schematically depict embodiments wherein the skin treatment head 200 comprises a skin treatment head surface 201. The skin treatment head 200 comprises one or more skin treatment elements 210, wherein the one or more skin treatment elements 210 comprise distal ends 217 defining a second face 202 remote from the skin treatment head surface 201. The first chamber opening 410 comprises a nozzle 411, wherein the nozzle 411 is configured between the skin treatment head surface 201 and the second face 202 when the skin treatment head 200 is comprised by the unit 300 or functionally coupled to the unit 300, such as is schematically depicted here.

FIGS. 3*a*-3*c* (but also other figures, such as 2*a*-2*d*, etc.) schematically depict embodiments wherein the chamber 400 comprises a chamber enclosure 415 enclosing at least part of the chamber volume 405. Especially, the chamber enclosure 415 comprises a chamber wall 417 having a cylindrical shape, wherein at least part of the chamber wall 417 is compressible. Hence, in embodiments the chamber wall may be made from a flexible and compressible material, such as e.g. silicon.

FIGS. 3*a*-3*c* also schematically depicts embodiments wherein the chamber 400 comprises a plurality of the first chamber openings 410 (with nozzles 411).

FIGS. 3*a*-3*c* also schematically depicts embodiments wherein the skin treatment head 200 comprises a plurality of bristles 211 as skin treatment elements 210, wherein the nozzle 411 is configured between the bristles 211.

Figure 4A:
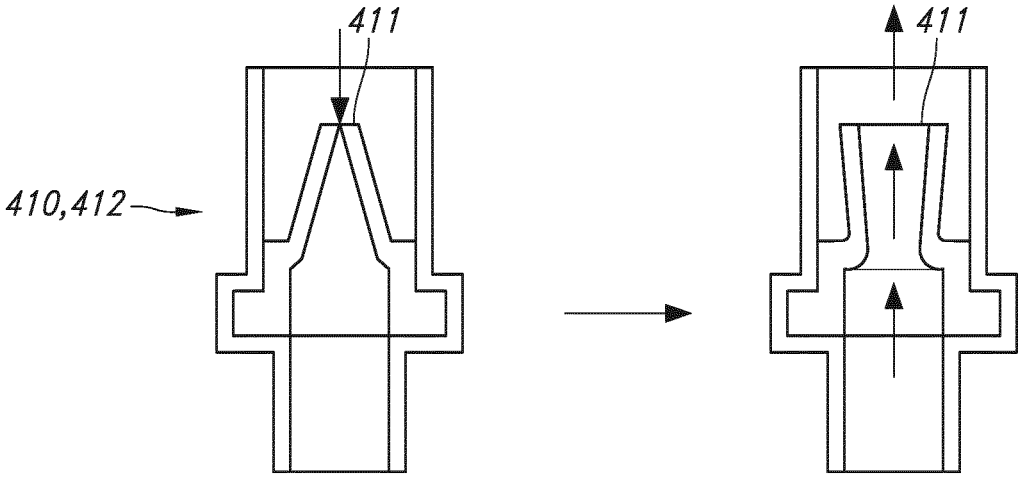
FIGS. 4*a*-4*b* schematically depicts some possible valves.
Figure 4B:
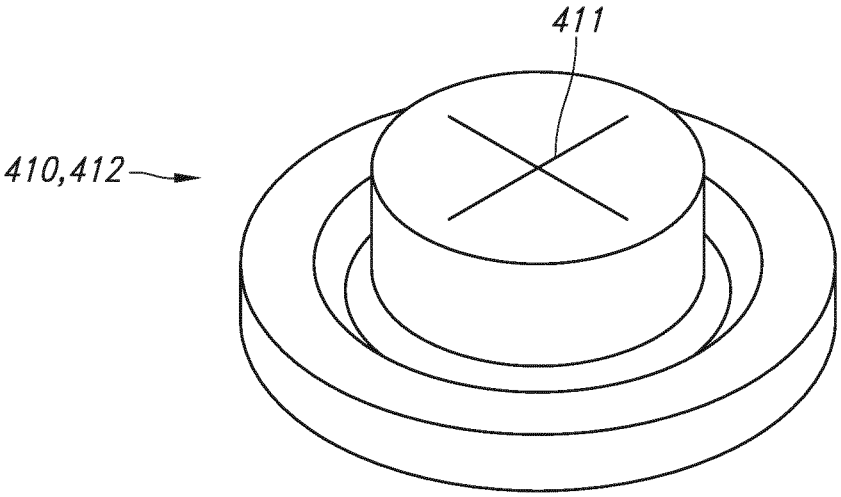

FIG. 4*a* schematically depicts an embodiment of a duckbill valve in a closed (left) and open (right) state. FIG. 4*b* schematically depicts an embodiment of a double duckbill valve (or "ketchup valve").

Figure 5A:
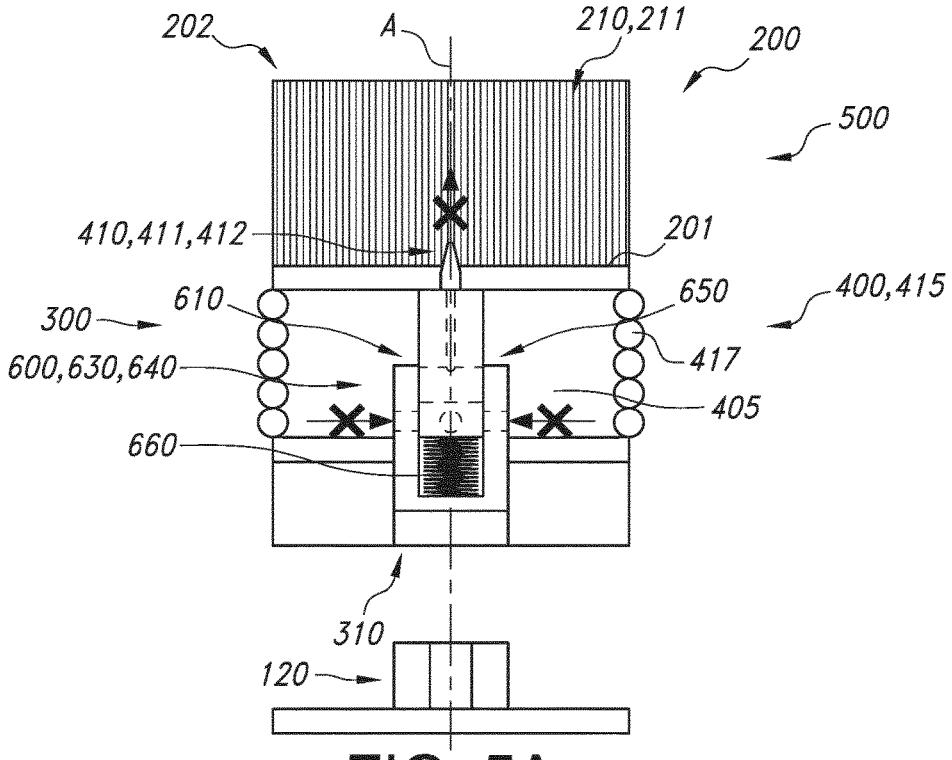
FIGS. 5*a*-5*d* schematically depict some further embodiments and aspects of the unit.
Figure 5B:
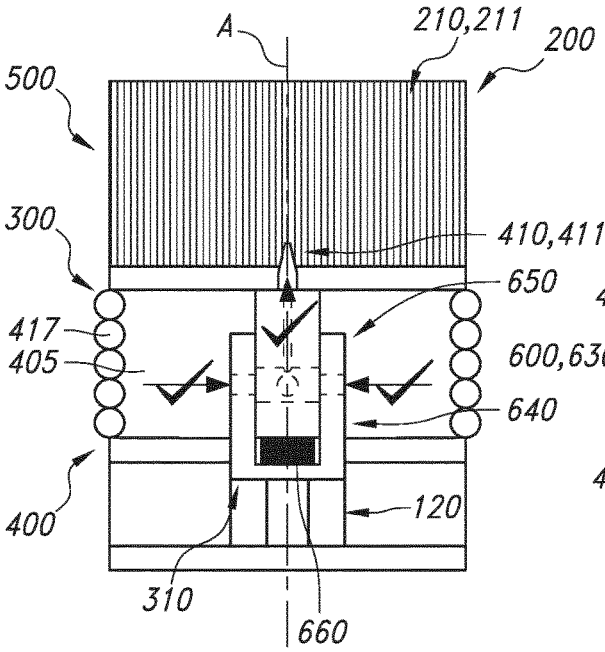
Figure 5C:
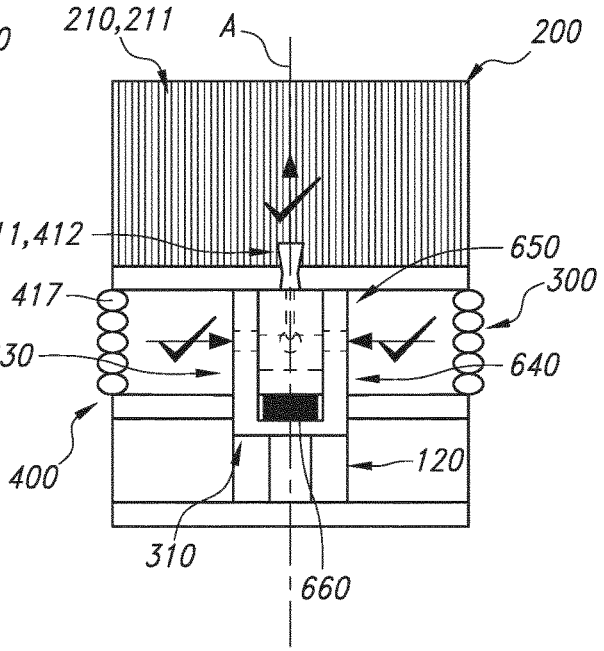

In embodiments, the unit may also be constructed as such, that it will only dispose additives/cosmetics when it is mounted onto a handle. An embodiment is schematically depicted in FIGS. 5*a*-5*d*. In embodiments, the unit can only dispose material from the flexible, for example silicon rubber, buffer or chamber, in between the bristle hairs when it is clicked on a handle. The mechanism that connects the unit may only then open the tubing (see also FIG. 5*d*) to guide the material through the chamber opening, such as comprising a duckbill valve. FIG. 5*a* shows the closed state, and FIGS. 5*b* and 5*c* shows the opened state; see also FIG. 5*d*, wherein on the left the closed and on the right the open state is shown. When the unit is compressed, a dose of material is released via the duckbill valve, or other valve, that then opens (see FIG. 5*c*). FIGS. 5*a*-5*d* also show an embodiment wherein thus the spring, or other type of spring element, moves a sliding element relative to a sleeve element (see also below) when the second connector element 120 of the housing is again taken out of the connecting part 310; the duckbill valve is closed when this is done.

FIGS. 5*a*-5*d* schematically depict embodiments wherein the unit 300 further comprises a channel system 600 for providing a fluid connection between the chamber 400 and the first chamber opening 410. These figures also show embodiments, wherein the unit 300 further comprises a first valve 610 for controlling the fluid connection between the chamber 400 and the first chamber opening 410, wherein the first connector element 310 is also configured to control the first valve 610. The first valve 610 is closed when the housing 100 and the unit 300 are not functionally coupled (see FIG. 5*a*, and FIG. 5*d* left), and the first valve 610 is open when the housing 100 and the unit 300 are functionally coupled (see FIGS. 5*b*, 5*c*, and FIG. 5*d* right).

Figure 5D:
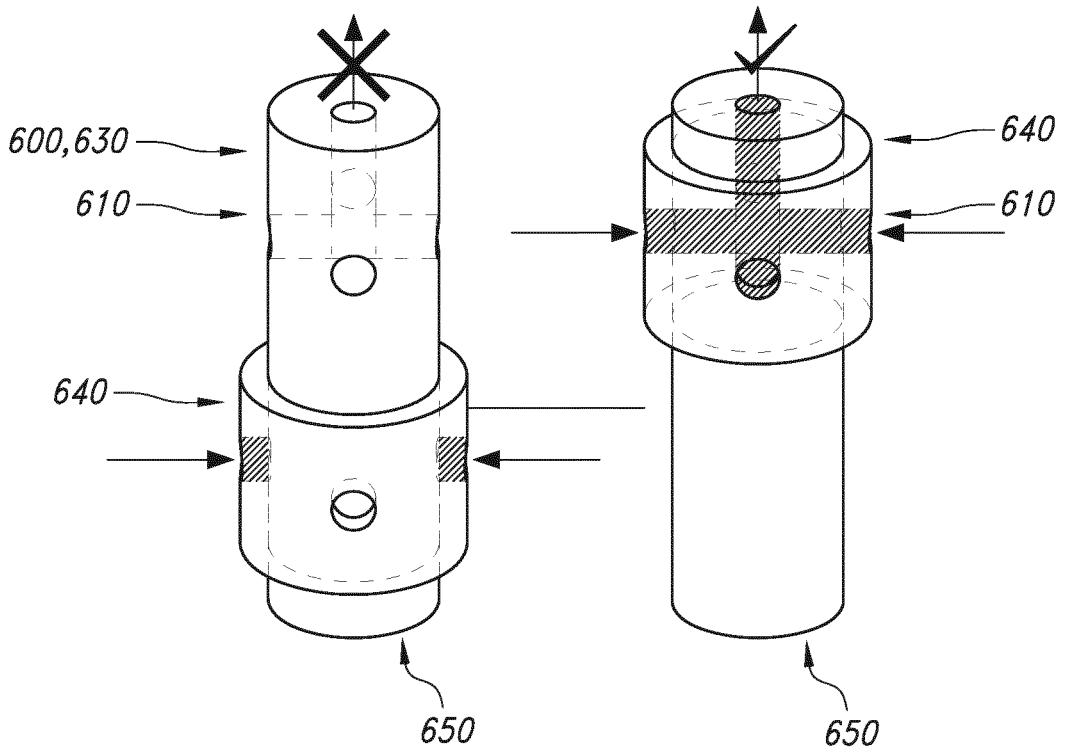

As shown in FIGS. 5*a*-5*d*, in embodiments the channel system 600 further comprises a valve system 630. The valve system 630 comprises a sliding element 650 and a sleeve element 640 for slidably hosting the sliding element 650. The valve system 630 is configurable in at least two configurations of the sliding element 650 relative to the sleeve element 640, wherein in a first configuration the first valve 610 is closed (FIG. 5*d* left), and wherein in a second configuration the first valve 610 is open (FIG. 5*d* right). As schematically depicted in FIG. 5*d*, in embodiments the sleeve element may slide over the sliding element.

As schematically depicted in FIGS. 5*a*-5*c*, the channel system 600 may further comprises a spring element 660 configured to maintain the valve system 630 in the first configuration, wherein further the spring element 660 is compressible until at least the second configuration of the valve system 630 can be reached. As schematically depicted, the first connector element 310 is functionally coupled to one of the sleeve element 640 and the sliding element 650. The first connector element 310 may further configured to keep the valve system 630 in the second configuration when the housing 100 and the unit 300 are functionally coupled (see FIGS. 5*b* and 5*c*).

In FIG. 5*c*, relative to FIG. 5*b*, the chamber 400 is compressed. Hence, an embodiment is shown wherein the mechanical actuator transfers a force on the skin treatment head 200 in a direction of the first connector element 310 onto the material to expel at least part of the material via the first chamber opening 410 out of the chamber 400. Hence, the mechanical actuator 500 is configured movable relative to the first connector element 310, wherein the wherein the mechanical actuator 500 is configurable in a plurality of positions relative to the first connector element 310 including a neutral position (see FIG. 5*b*) wherein the mechanical actuator 500 does not transfer a force onto the material 10.

Figure 6:
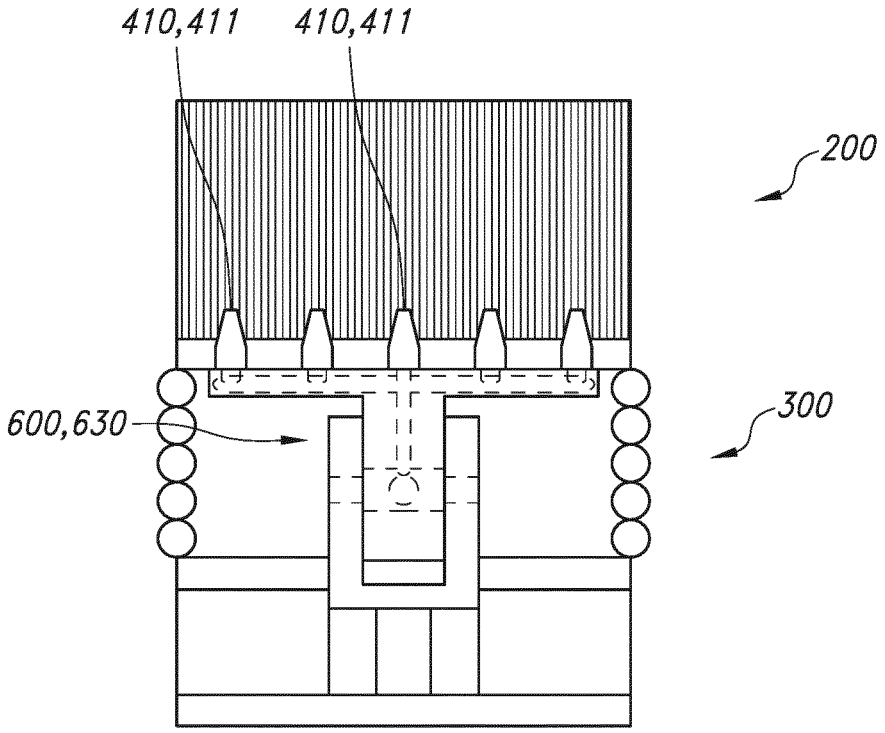
FIG. 6 schematically depict some further aspects of embodiments of the unit.

The unit may also comprise a plurality of chamber openings, as schematically depicted in FIG. 6.

Figure 7A:
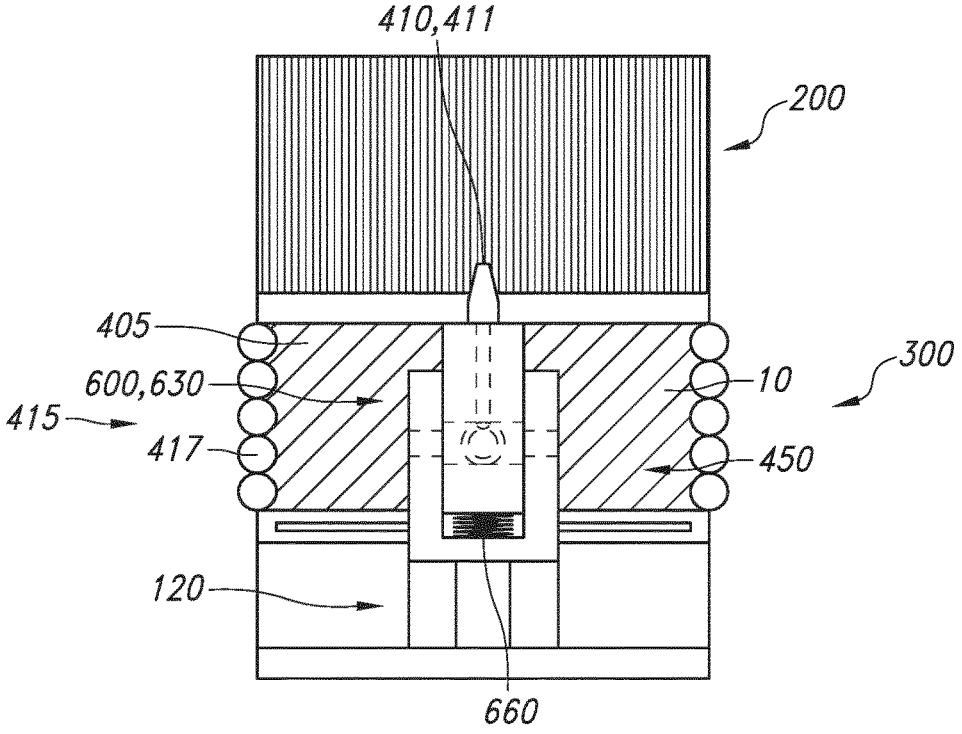
FIGS. 7*a*-7*b* schematically depict some further aspects of embodiments of the unit.
Figure 7B:
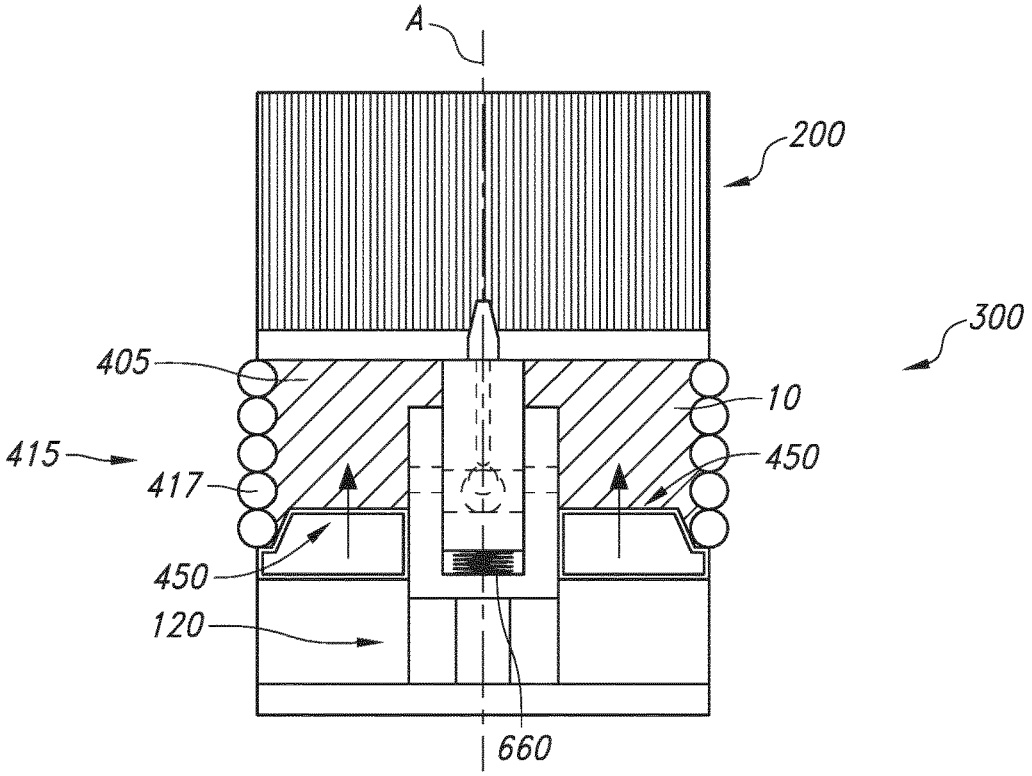

FIGS. 7*a*-7*b* schematically depicted en an embodiment showing that when the chamber is getting less filled, an additional membrane construction could be considered to keep pressure on the material in the buffer.

Hence, FIGS. 7*a*-7*b* schematically depict an embodiment further comprising a spring-loaded element 450 configured to provide a continuous pressure to the material 10 over at least part of a filling range of the chamber volume 405 with the material 10.

Figure 8:
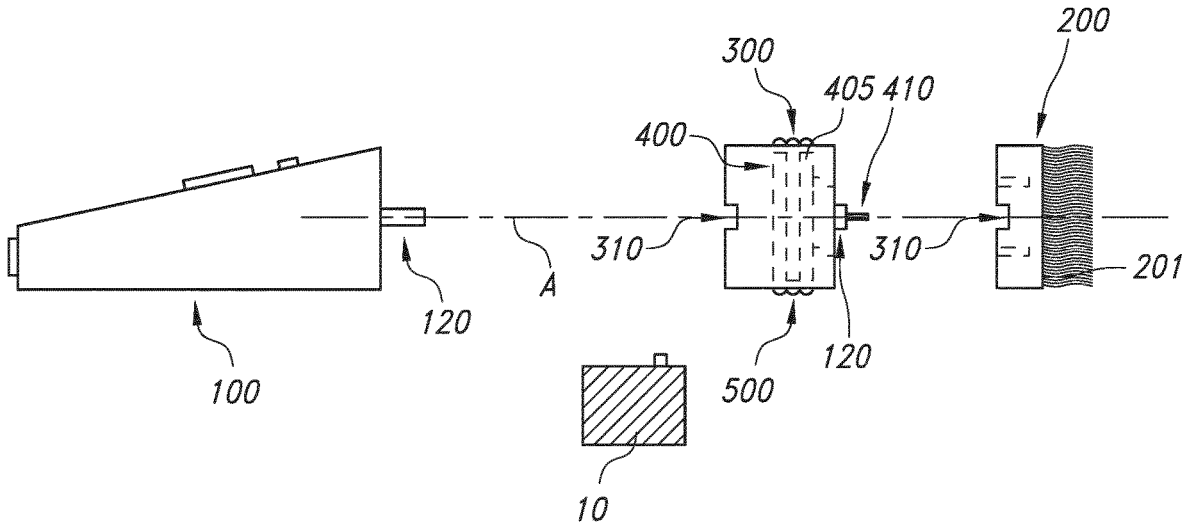
FIG. 8 schematically depict embodiments of the kit of parts.

FIG. 8 schematically depicts an embodiment of a kit of parts comprising the unit 300, the housing 100, and the skin treatment head 200. The skin treatment head 200 may be comprised by the unit 300 or can be functionally coupled to the unit 300. Here, an embodiment is shown wherein the skin treatment head 200 can functionally be coupled to the unit 300. FIG. 8 also schematically depicts an embodiment wherein the kit of parts further comprises a container 700. The container contains the material 10, which material 10 is especially selected from the group consisting of a liquid and a semi-liquid.

As indicated above, the invention also provides a kit of parts comprising the body care device 1 as defined herein, and a container 700, wherein the container 700 contains the material 10 selected from the group consisting of a liquid and a semi-liquid.

Figure 9:
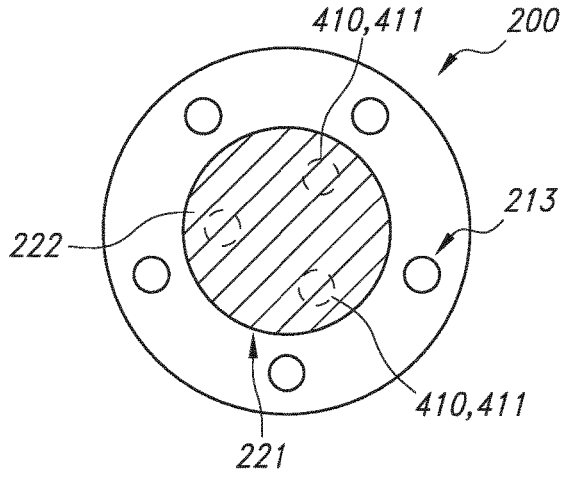
FIG. 9 schematically depict further aspects of embodiments of the skin treatment head.

FIG. 9, but also explicitly FIGS. 3*a*-3*c* and FIGS. 5*a*-5*c*, 6, and 7*a*-7*c* schematically depicts embodiments wherein the skin treatment head 200 comprises a plurality of bristles 211 as skin treatment elements 210, wherein the nozzle 411 is configured between the bristles 211, or wherein the skin treatment head 200 comprises a plurality of massaging elements 213 as skin treatment elements 210, wherein the nozzle 411 is configured between the massaging elements 213, or wherein the skin treatment head 200 comprises a sponge-like element 222 as skin treatment element 210, wherein the nozzle 411 extends into the sponge-like element 222. Amongst others, FIG. 9 schematically depicts an embodiment wherein the nozzle 411 is configured between the massaging elements 213, or wherein the skin treatment head 200 comprises a sponge-like element 222 as skin treatment element 210, wherein the nozzle 411 extends into the sponge-like element 222.

The term "plurality" refers to two or more.

The terms "substantially" or "essentially" herein, and similar terms, will be understood by the person skilled in the art. The terms "substantially" or "essentially" may also include embodiments with "entirely", "completely", "all", etc. Hence, in embodiments the adjective substantially or essentially may also be removed. Where applicable, the term "substantially" or the term "essentially" may also relate to 90% or higher, such as 95% or higher, especially 99% or higher, even more especially 99.5% or higher, including 100%.

The term "comprise" includes also embodiments wherein the term "comprises" means "consists of".

The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices, apparatus, or systems may herein amongst others be described during operation. As will be clear to the person skilled in the art, the invention is not limited to methods of operation, or devices, apparatus, or systems in operation.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim.

Use of the verb "to comprise" and its conjugations does not exclude the presence of elements or steps other than those stated in a claim. Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

The article "a" or "an" preceding an element does not exclude the presence of a plurality of such elements.

The invention may be implemented by means of hardware comprising several distinct elements, and by means of a suitably programmed computer. In a device claim, or an apparatus claim, or a system claim, enumerating several means, several of these means may be embodied by one and the same item of hardware. The mere fact that certain measures are recited in mutually different dependent claims does not indicate that a combination of these measures cannot be used to advantage.

The invention also provides a control system that may control the device, apparatus, or system, or that may execute the herein described method or process. Yet further, the invention also provides a computer program product, when running on a computer which is functionally coupled to or comprised by the device, apparatus, or system, controls one or more controllable elements of such device, apparatus, or system.

The invention further applies to a device, apparatus, or system comprising one or more of the characterizing features described in the description and/or shown in the attached drawings. The invention further pertains to a method or process comprising one or more of the characterizing features described in the description and/or shown in the attached drawings.

The various aspects discussed in this patent can be combined in order to provide additional advantages. Further, the person skilled in the art will understand that embodiments can be combined, and that also more than two embodiments can be combined. Furthermore, some of the features can form the basis for one or more divisional applications.

The invention claimed is:

1. A unit of a body care device for operating a skin treatment head coupled to or integrated with the unit, wherein the unit comprises:

a first connector for detachably coupling to a corresponding second connector of a housing of the body care device to provide functional coupling of the housing and the unit, wherein the functional coupling enables at least partial rotation of the unit about an axis;

a chamber with a chamber volume for hosting a material selected from the group consisting of a liquid and a semi-liquid, wherein the chamber comprises at least one first chamber opening, wherein the at least one first chamber opening comprises a check valve;

a mechanical actuator movable relative to the first connector, wherein the mechanical actuator is configured to transfer a force on the skin treatment head in a direction of the first connector onto the material to expel at least part of the material via the at least one first chamber opening out of the chamber, wherein the mechanical actuator is configurable in a plurality of positions relative to the first connector including a neutral position wherein the mechanical actuator does not transfer a force onto the material;

a channel system for providing a fluid connection between the chamber and the at least one first chamber opening; and a first valve for controlling the fluid connection between the chamber and the at least one first chamber opening, wherein the first connector is configured to control the first valve, wherein the first valve is closed when the housing and the unit are not functionally coupled, and wherein the first valve is open when the housing and the unit are functionally coupled.

2. The unit according to claim 1, wherein the at least one first chamber opening comprises a duckbill valve.

3. The unit according to claim 1, further comprising a spring-loaded element configured to provide a continuous pressure to the material over at least part of a filling range of the chamber volume with the material.

4. The unit according to claim 1, wherein the chamber comprises a chamber enclosure enclosing at least part of the chamber volume, wherein the chamber enclosure comprises a chamber wall having a cylindrical shape, wherein at least part of the chamber wall is compressible.

5. The unit according to claim 1, wherein the chamber comprises a plurality of the first chamber openings.

6. The unit according to claim 5, wherein the channel system comprises:

a valve system comprising a sliding element and a sleeve element for slidably hosting the sliding element, wherein the valve system is configurable in at least two configurations of the sliding element relative to the sleeve element, wherein in a first configuration the first valve is closed, and wherein in a second configuration the first valve is open; and a spring element configured to maintain the valve system in the first configuration, wherein the spring element is compressible until at least the second configuration of the valve system can be reached, wherein the first connector is functionally coupled to one of the sleeve element and the sliding element, wherein the first connector is further configured to keep the valve system in the second configuration when the housing and the unit are functionally coupled.

7. A body care device for treating a skin, the body care device comprising the housing, the unit and the skin treatment head as defined in claim 1.

8. A kit of parts for treating skin, comprising:

a housing comprising an actuator;

a unit configured to functionally couple to the housing, wherein the actuator is configured to at least partly rotate the unit about an axis when the unit is functionally coupled to the housing; and a skin treatment head, wherein the skin treatment head is comprised by the unit or configured to functionally couple to the unit, wherein the unit comprises:

a first connector configured to detachably couple to a corresponding second connector of the housing to provide the functional coupling of the housing and the unit;

a chamber having a chamber volume for hosting a material from the group consisting of a liquid or a semi-liquid, wherein the chamber comprises a first chamber opening, wherein the first chamber opening comprises a check valve;

a mechanical actuator movable relative to the first connector, wherein the mechanical actuator is configured to transfer a force on the skin treatment head in a direction of the first connector onto the material in the chamber volume to expel at least part of the material via the first chamber opening out of the chamber, wherein the mechanical actuator is configurable in a plurality of positions relative to the first connector, including a neutral position causing the mechanical actuator to transfer no force onto the material;

a channel system configured to provide a fluid connection between the chamber and the first chamber opening; and a first valve configured to control the fluid connection between the chamber and the first chamber opening, wherein the first valve is controllable by the first connector, wherein the first valve is closed when the housing and the unit are not functionally coupled, and wherein the first valve is open when the housing and the unit are functionally coupled.

9. The kit of parts according to claim 8, further comprising a container, wherein the container contains the material selected from the group consisting of the liquid and the semi-liquid.

10. A method of treating a part of a skin using the body care device according to claim 9, the method comprising:

(a) providing the material selected from the group consisting of the liquid and the semi-liquid contained in the chamber to one or more of (i) the part of the skin and (ii) the skin treatment head; and (b) applying the skin treatment head to the part of the skin by rotating the skin treatment head.

11. The method according to claim 10, wherein the material comprises one or more of a cosmetic material, a skin care material, and a pharmaceutical material.

12. A body care device for treating skin, comprising:

a housing comprising an actuator;

a unit functionally coupled to the housing, wherein the actuator is configured to at least partly rotate the unit about an axis when the unit is functionally coupled to the housing; and a skin treatment head functionally coupled to or integrated with the unit, wherein the unit comprises:

a first connector configured to detachably couple to a corresponding second connector of the housing to provide the functional coupling of the housing and the unit;

a chamber having a chamber volume for hosting a material comprising a liquid or a semi-liquid, wherein the chamber comprises a first chamber opening, wherein the first chamber opening comprises a check valve;

a mechanical actuator movable relative to the first connector, wherein the mechanical actuator is configured to transfer a force on the skin treatment head in a direction of the first connector onto the material in the chamber volume to expel at least part of the material via the first chamber opening out of the chamber, wherein the mechanical actuator is configurable in a plurality of positions relative to the first connector, including a neutral position causing the mechanical actuator to transfer no force onto the material;

a channel system configured to provide a fluid connection between the chamber and the first chamber opening; and a first valve configured to control the fluid connection between the chamber and the first chamber opening, wherein the first valve is controllable by the first connector, wherein the first valve is closed when the housing and the unit are not functionally coupled, and wherein the first valve is open when the housing and the unit are functionally coupled.

13. The body care device according to claim 12, wherein the skin treatment head comprises:

a skin treatment head surface; and one or more skin treatment elements, wherein the one or more skin treatment elements comprise distal ends defining a second face remote from the skin treatment head surface, wherein the first chamber opening comprises a nozzle configured between the skin treatment head surface and the second face defined by the one or more skin treatment elements.

14. The body care device according to claim 13, wherein the skin treatment head further comprises a plurality of bristles as skin treatment elements, wherein the nozzle is configured between the bristles.

15. The body care device according to claim 13, wherein the skin treatment head further comprises a plurality of massaging elements as skin treatment elements, wherein the nozzle is configured between the massaging elements.

16. The body care device according to claim 13, wherein the skin treatment head further comprises a sponge-like element as skin treatment element, wherein the nozzle extends into the sponge-like element.

17. The body care device according to claim 12, wherein the material comprises at least one of a cosmetic material, a skin care material, or a pharmaceutical material.

18. The body care device according to claim 12, wherein the channel system comprises:

a valve system comprising a sliding element and a sleeve element for slidably hosting the sliding element, the valve system being configurable in a first configuration wherein the first valve is closed, and in a second configuration wherein the first valve is open; and a spring element configured to maintain the valve system in the first configuration, wherein the spring element is compressible until at least the second configuration of the valve system can be reached, wherein the first connector is functionally coupled to one of the sleeve element and the sliding element, wherein the first connector is further configured to keep the valve system in the second configuration when the housing and the unit are functionally coupled.

19. The body care device according to claim 12, wherein the first chamber opening comprises a duckbill valve.

20. The body care device according to claim 12, further comprising:

a spring-loaded element configured to provide a continuous pressure to the material over at least part of a filling range of the chamber volume with the material.

* * * * *